US011464323B2

(12) United States Patent
Ryu

(10) Patent No.: US 11,464,323 B2
(45) Date of Patent: Oct. 11, 2022

(54) TOOTHBRUSH

(71) Applicant: Sungmin Ryu, Seongnam-si (KR)

(72) Inventor: Sungmin Ryu, Seongnam-si (KR)

( * ) Notice: Subject to any disclaimer, the term of this patent is extended or adjusted under 35 U.S.C. 154(b) by 102 days.

(21) Appl. No.: 16/622,904

(22) PCT Filed: Jun. 12, 2018

(86) PCT No.: PCT/KR2018/006627
§ 371 (c)(1),
(2) Date: Dec. 13, 2019

(87) PCT Pub. No.: WO2018/230921
PCT Pub. Date: Dec. 20, 2018

(65) Prior Publication Data

US 2021/0153636 A1 May 27, 2021

(30) Foreign Application Priority Data

Jun. 13, 2017 (KR) ..... 10-2017-0073645

(51) Int. Cl.
*A46B 9/02* (2006.01)
*A46B 9/04* (2006.01)

(52) U.S. Cl.
CPC ..... *A46B 9/028* (2013.01); *A46B 9/045* (2013.01); *A46B 2200/1066* (2013.01)

(58) Field of Classification Search
CPC .. A46B 9/00; A46B 9/02; A46B 9/028; A46B 9/04; A46B 9/045; A46B 7/00
(Continued)

(56) References Cited

U.S. PATENT DOCUMENTS 2,186,005 A * 1/1940 Casto ..... A46B 9/04 15/167.1
2,305,461 A * 12/1942 Spyra ..... A46B 9/04 15/167.1

(Continued)

FOREIGN PATENT DOCUMENTS

JP 3163229 U 9/2010
KR 10-1530504 B1 6/2015

OTHER PUBLICATIONS https://www.bauersmiles.com/2014/03/tooth-width-length.html/ (Year: 2014).*

*Primary Examiner* — Orlando E Aviles
*Assistant Examiner* — Jason Khalil Hawkins
(74) *Attorney, Agent, or Firm* — Korus Patent, LLC; Seong Il Jeong

(57) ABSTRACT

Provided is a toothbrush including a handle, a head connected to the handle and including a first surface, a distal circumference provided at a front end of the first surface, a proximal circumference provided at a rear end of the first surface, a plurality of first cleaning elements provided at the front end of the first surface along the distal circumference, a plurality of second cleaning elements provided at the rear end of the first surface, and a tooth space corresponding to a space provided on the first surface between the first and second cleaning elements. According to the present invention, when a space between a tooth root surface and a gum, e.g., a periodontal pocket, is cleaned, pressing of bristles due to interference between the bristles and a tooth may be prevented and thus first cleaning elements may easily penetrate into the periodontal pocket.

4 Claims, 19 Drawing Sheets

(58) Field of Classification Search
USPC ..... 15/167
See application file for complete search history.

(56) References Cited

U.S. PATENT DOCUMENTS

| | | | | | |
|---|---|---|---|---|---|
| 4,519,111 | A * | 5/1985 | Cavazza | A46B 9/04 | 15/167.1 |
| 4,766,633 | A * | 8/1988 | Clark | A46B 9/04 | 15/110 |
| 6,006,394 | A * | 12/1999 | Bredall | A46B 9/026 | 15/167.1 |
| 6,314,605 | B1 * | 11/2001 | Solanki | A46B 5/0025 | 15/167.1 |
| 8,533,891 | B2 * | 9/2013 | Waguespack | A46B 7/06 | 15/167.1 |
| 2003/0140442 | A1 * | 7/2003 | Aoyama | A46B 9/005 | 15/167.1 |
| 2011/0219558 | A1 * | 9/2011 | Vitt | A46B 3/22 | 15/167.1 |

* cited by examiner

TOOTHBRUSH

TECHNICAL FIELD

The present invention relates to a toothbrush, and more particularly, to a toothbrush including bristles capable of easily penetrating into and cleaning a periodontal pocket formed between a tooth root surface and a gum.

BACKGROUND ART

Toothbrushes are used to clean teeth by removing foreign substances such as tartar from the surfaces of the teeth.

Due to the form of bristles provided on the entirety of a top surface of a head, existing toothbrushes may not easily penetrate into and wash out foreign substances such as tartar from a space between a tooth root surface and a gum, e.g., a periodontal pocket, or clean along the gingival sulcus.

In addition, the existing toothbrushes are very efficient at cleaning exposed tooth surfaces outside the gums but may not easily clean, for example, a periodontal pocket serving as a major cause of periodontitis.

Because a space between a tooth root surface and a gum is not exposed, bristles need to penetrate into the space. However, using the existing toothbrushes, when a user pushes the bristles into the space, a tooth presses adjacent bristles and the pressed bristles have repulsive force which repels the head of the toothbrush.

Therefore, using the existing toothbrushes, the bristles may not easily penetrate into the space between the tooth root surface and the gum and the user may easily feel fatigued in a hand holding the toothbrush.

DETAILED DESCRIPTION OF THE INVENTION

Technical Problem

The present invention provides a toothbrush having an improved structure including bristles capable of easily penetrating into and cleaning a periodontal pocket formed between a tooth root surface and a gum.

Technical Solution

According to an aspect of the present invention, there is provided a toothbrush including a handle, a head connected to the handle and including a first surface, a distal circumference provided at a front end of the first surface, a proximal circumference provided at a rear end of the first surface, a longitudinal axis, and a lateral axis, a plurality of first cleaning elements provided at the front end of the first surface along the distal circumference of the first surface, a plurality of second cleaning elements provided at the rear end of the first surface, and a tooth space corresponding to a space provided on the first surface between the first and second cleaning elements.

The tooth space may be provided to accommodate an average-sized molar tooth of people.

The tooth space may be provided in an elliptical shape having the longitudinal axis of the head as a major axis.

The tooth space may have a maximum length of 8 mm to 12 mm along the longitudinal axis of the head.

The tooth space may have a maximum width of 4 mm to 7 mm along the lateral axis of the head.

No cleaning elements may be provided in a region of the first surface where the tooth space is positioned.

The tooth space may be provided in a region having an area corresponding to 30% to 50% of an area of the first surface.

The tooth space may be provided in a semi-elliptical shape having the longitudinal axis of the head as a major axis.

The first cleaning elements may have a maximum height to be insertable to a predetermined depth into a space between a tooth root surface and a gum.

The first cleaning elements may be provided in a region having an area corresponding to 10% to 30% of an area of the first surface.

The first cleaning elements may be provided along a circumference corresponding to 20% to 60% of a whole circumference of the first surface.

The first cleaning elements may be provided in a band-shaped region having a width of 2 mm to 4 mm.

The first cleaning elements may have an average height equal to or greater than an average height of the second cleaning elements.

A height of the first cleaning elements may be gradually reduced from the front end of the first surface toward the rear end of the first surface along the longitudinal axis.

The second cleaning elements may be provided in a region having an area corresponding to 40% to 60% of an area of the first surface.

A height of the second cleaning elements may be gradually reduced from the rear end of the first surface toward the front end of the first surface along the longitudinal axis.

The second cleaning elements may include cleaning elements provided in an elliptical region having the longitudinal axis of the head as a major axis.

A minimum distance between the first and second cleaning elements may be equal to or greater than a predetermined value.

Advantageous Effects

According to the present invention, when a space between a tooth root surface and a gum, e.g., a periodontal pocket, is cleaned, pressing of bristles due to interference between the bristles and a tooth may be prevented and thus first cleaning elements may easily penetrate into the periodontal pocket.

According to the present invention, a space between a tooth root surface and a gum may be cleaned using first cleaning elements provided at a front end of a head, and exposed surfaces of teeth, e.g., occlusal surfaces, may be cleaned using second cleaning elements provided at a rear end of the head.

BEST MODE

Hereinafter, the present invention will be described in detail by explaining embodiments of the invention with reference to the attached drawings.

Figure 1:
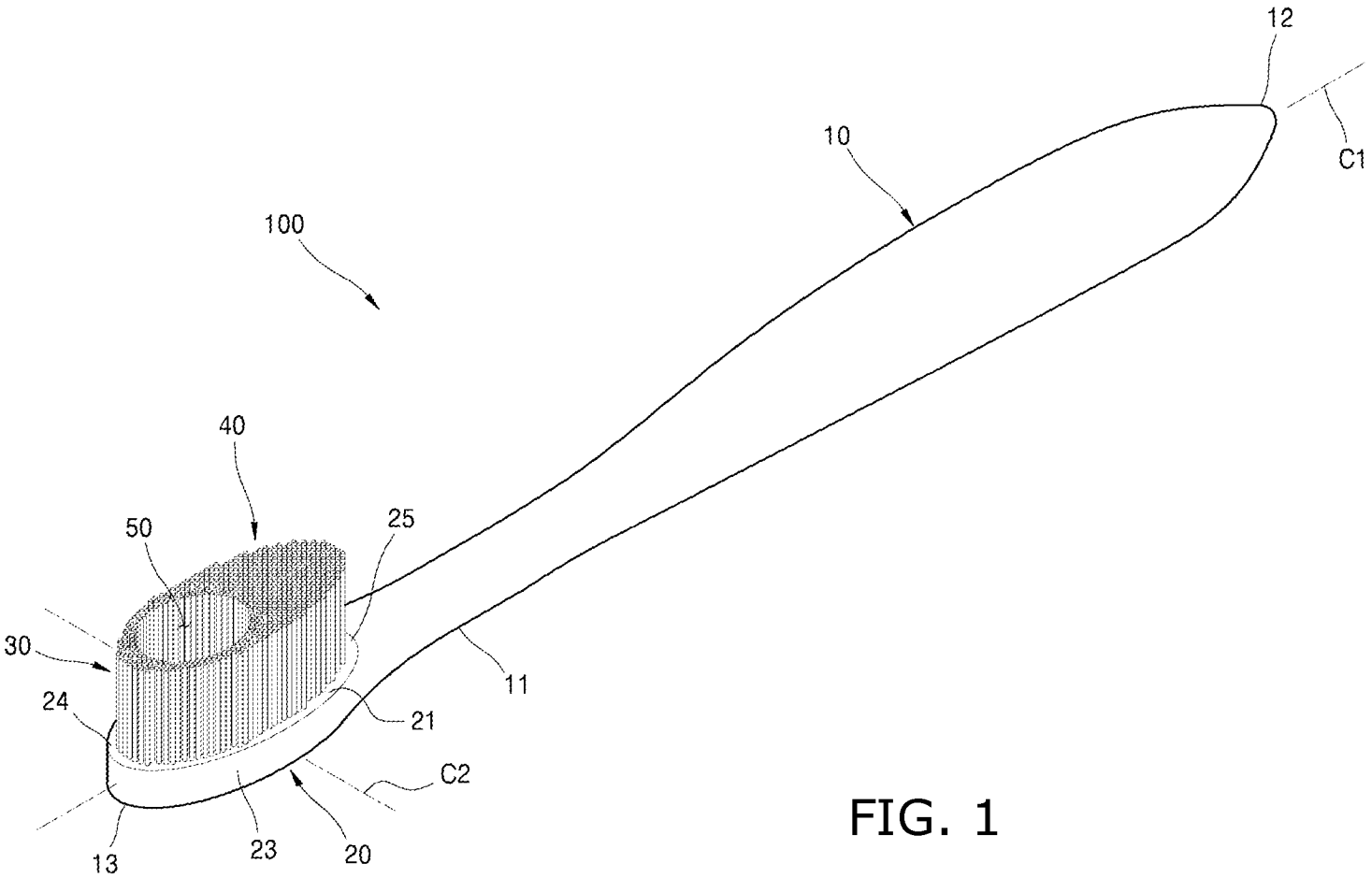
FIG. 1 is a perspective view of a toothbrush according to a first embodiment of the present invention.
Figure 2:
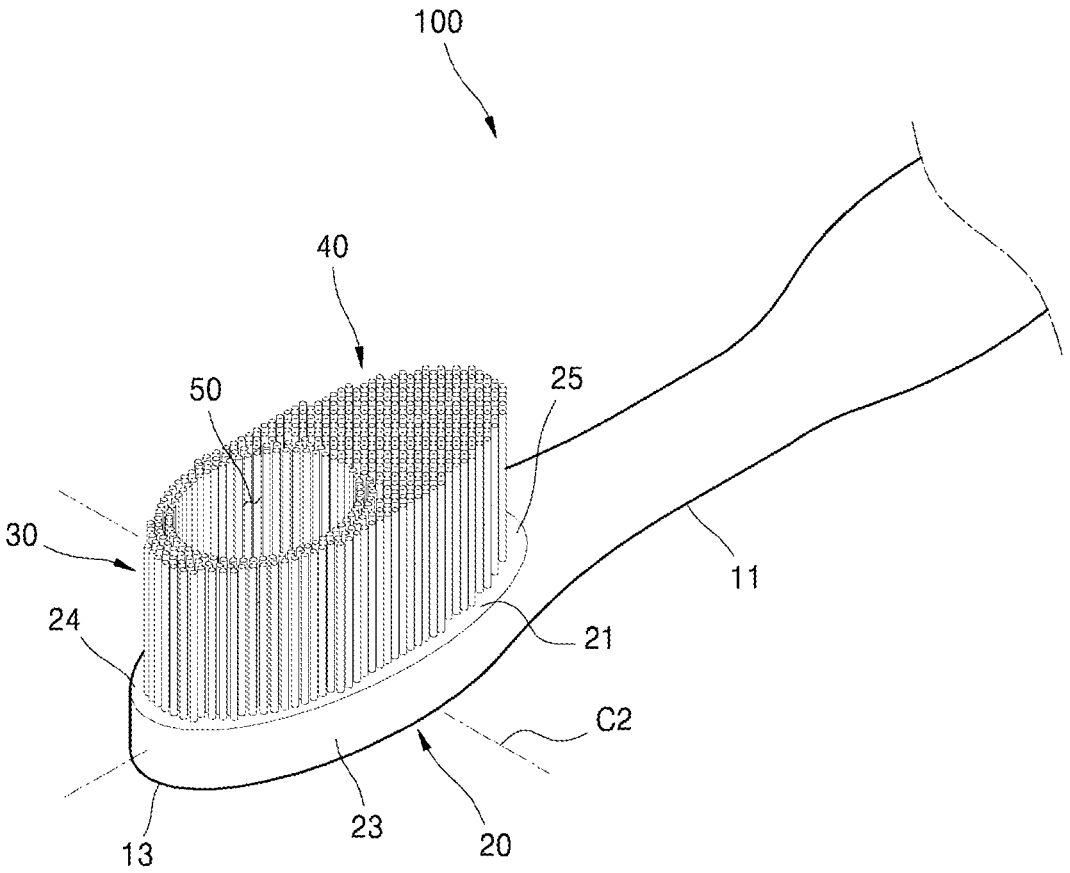
FIG. 2 is a magnified view of the toothbrush illustrated in FIG. 1.
Figure 3:
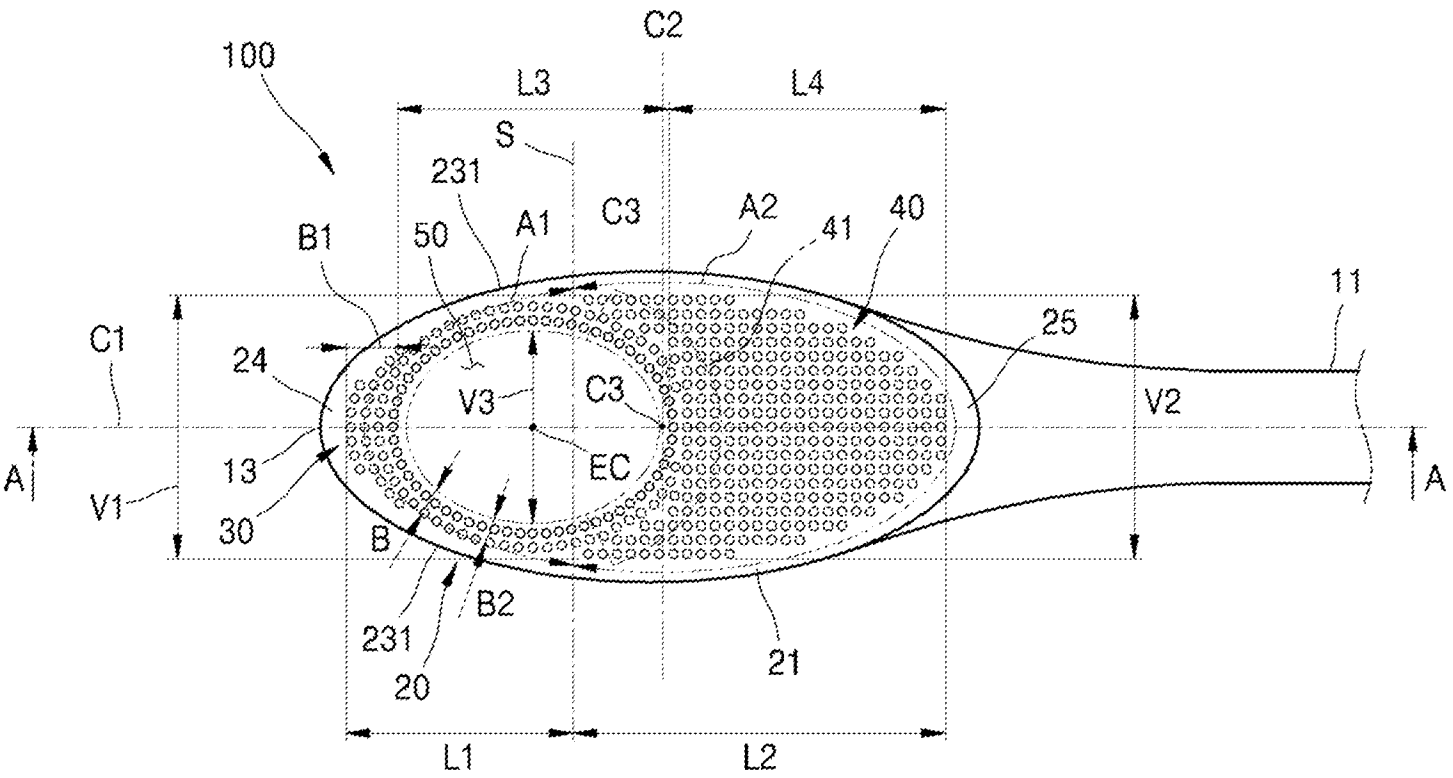
FIG. 3 is a plan view of the toothbrush illustrated in FIG. 2.

FIG. 1 is a perspective view of a toothbrush 100 according to a first embodiment of the present invention, and FIG. 2 is a magnified view of the toothbrush 100 illustrated in FIG. 1. FIG. 3 is a plan view of the toothbrush 100 illustrated in FIG. 2.

Referring to FIGS. 1 to 3, the toothbrush 100 according to an embodiment of the present invention is a manual toothbrush used to clean teeth T by removing foreign substances such as tartar from the surfaces of the teeth T, and includes a handle 10, a head 20, first cleaning elements 30, second cleaning elements 40, and a tooth space 50.

The handle 10 provides, to a user, a mechanism by which the user may easily hold and manipulate the toothbrush 100.

The handle 10 is illustrated as a general handle and may be formed in various shapes and sizes by using various materials and manufacturing methods well-known to those of ordinary skill in the art.

When necessary, the handle 10 may include an appropriate-texture grip (not shown) made of an elastomeric material, or another component.

The toothbrush 100 extends from a proximal end 12 to a distal end 13 along a longitudinal axis C1. As used herein, relative terms such as "distal", "middle", "proximal", "top", "bottom", "upper", "lower", "left", and "right" are merely used to describe relative positions of elements of the toothbrush 100 with respect to each other, and the present invention is not limited by the intentions of definitions of the terms.

The head 20 includes a front surface 21 also called a first surface, a rear surface 22, and a side surface 23, and is operatively connected through a neck 11 to the handle 10.

In the current embodiment, the head 20 and the handle 10 are formed as a single structure by using molding, milling, machining, or another appropriate process.

The head 20 includes a distal circumference 24 provided at a front end of the first surface 21, a proximal circumference 25 provided at a rear end of the first surface 21, the longitudinal axis C1, and a lateral axis C2 perpendicularly crossing the longitudinal axis C1.

In the current embodiment, as illustrated in FIG. 3, the head 20 is provided in an elliptical shape having the longitudinal axis C1 as a major axis and having the lateral axis C2 as a minor axis. Herein, a perpendicular axis C3 perpendicular to both of the longitudinal and lateral axes C1 and C2 is provided at a point where the longitudinal and lateral axes C1 and C2 cross each other, and is positioned at an ellipse center of the head 20.

The first cleaning elements 30 are cleaning elements provided at the front end of the first surface 21 to clean a space C between a tooth root surface and a gum G.

As used herein, the term "cleaning element" is used in a generic sense to refer to any structure that is usable to clean or massage the surface of the oral cavity through relative surface contact. Common examples of "tooth cleaning elements" include, but are not limited to, filament bristles, fiber bristles, nylon bristles, spiral bristles, rubber bristles, elastomeric protrusions, flexible polymer protrusions, co-extruded filaments, flag bristles, crimped bristles, anti-bacterial bristles, and combinations thereof, and/or structures including such materials or combinations.

In the current embodiment, a plurality of first cleaning elements 30 are provided as filament bristles along the distal circumference 24 of the first surface 21.

Figure 4:
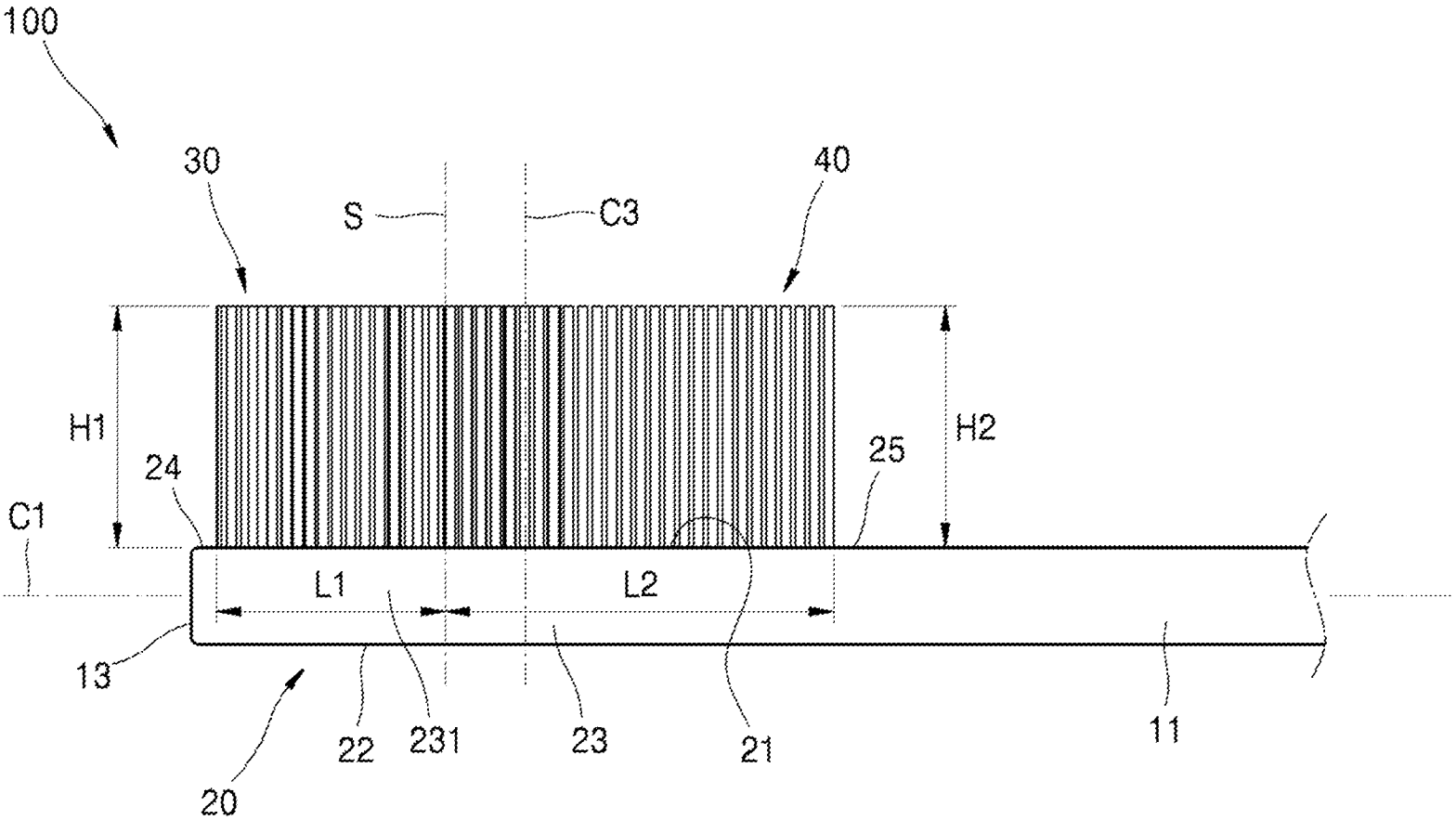
FIG. 4 is a front view of the toothbrush illustrated in FIG. 2.
Figure 5:
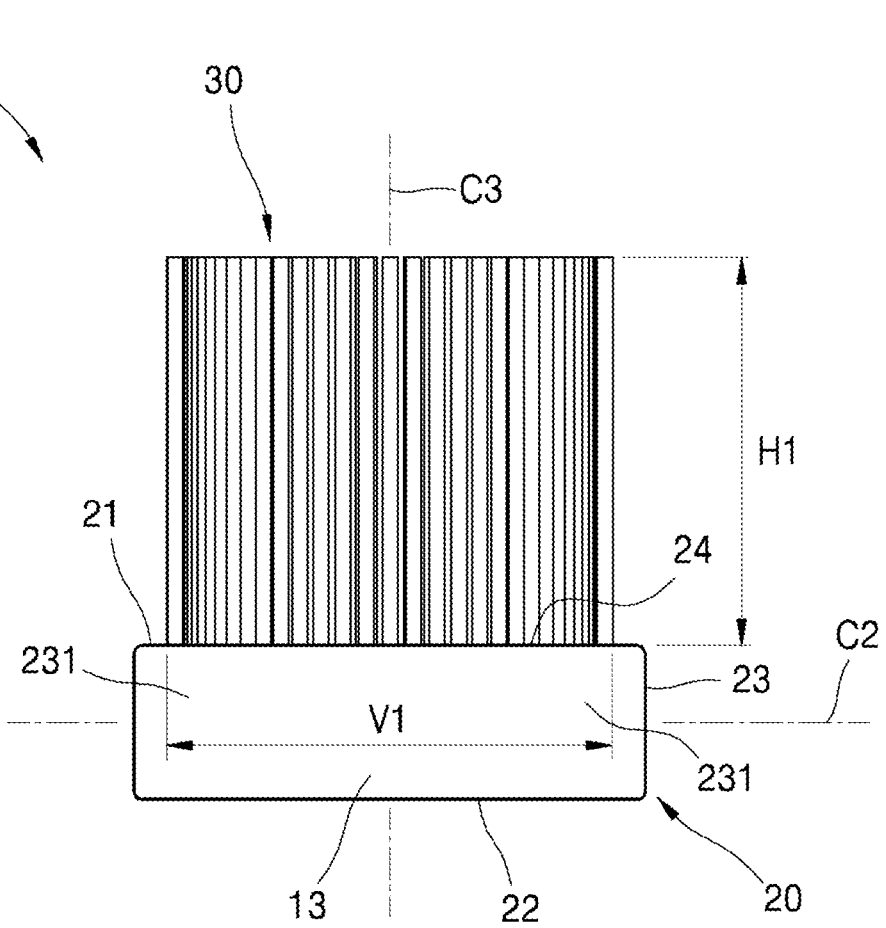
FIG. 5 is a left side view of the toothbrush illustrated in FIG. 2.
Figure 6:
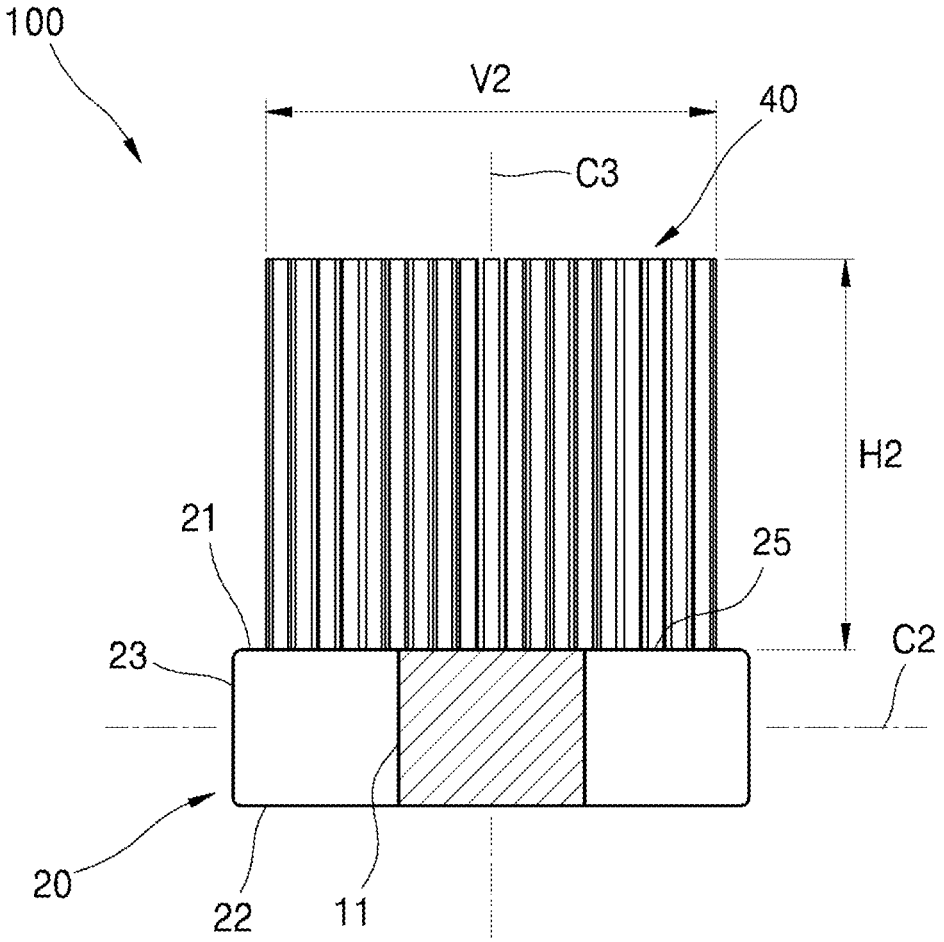
FIG. 6 is a right side view of the toothbrush illustrated in FIG. 2.
Figure 7:
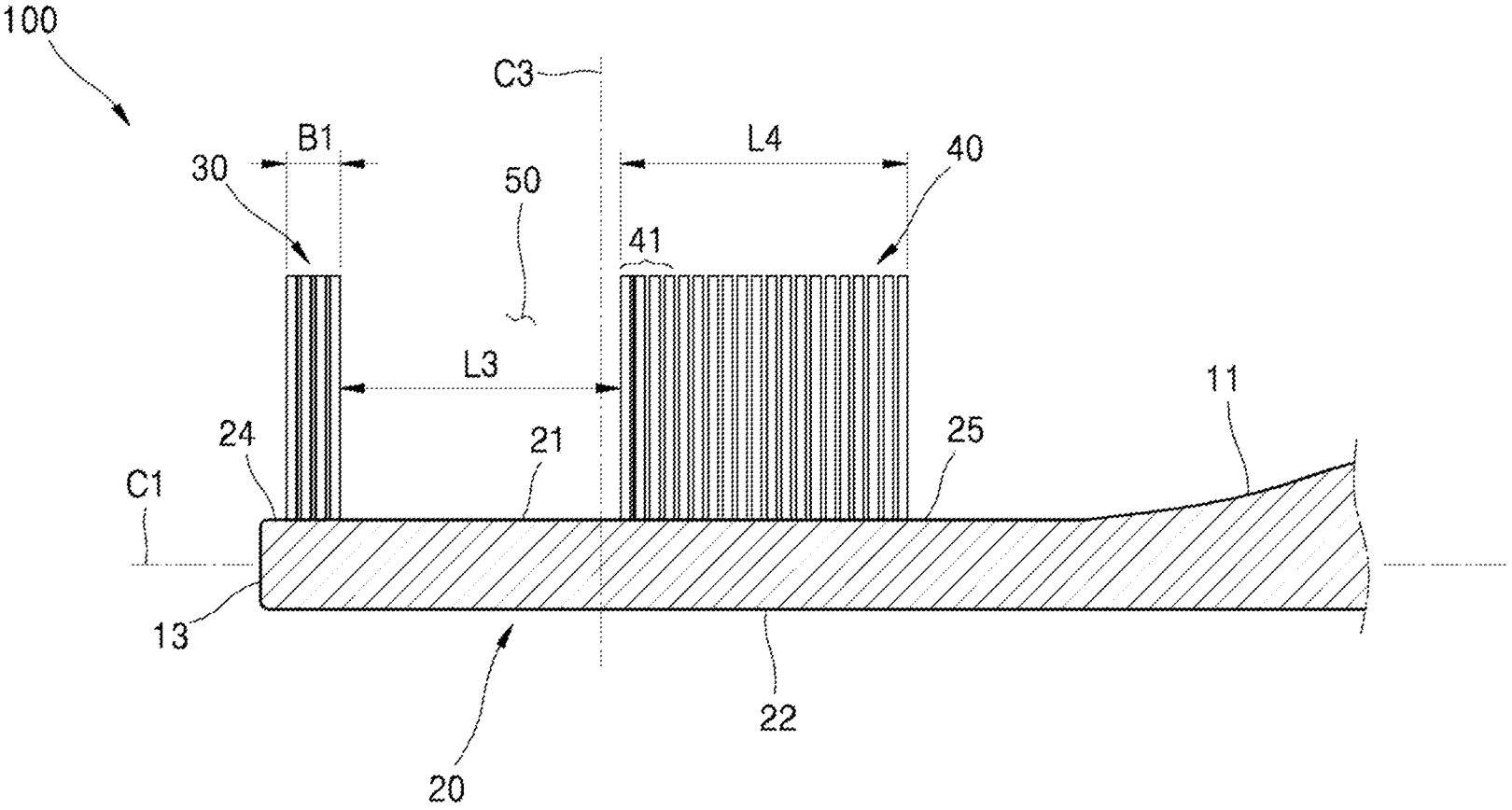
FIG. 7 is a cross-sectional view taken along line A-A of the toothbrush illustrated in FIG. 3.
Figure 8:
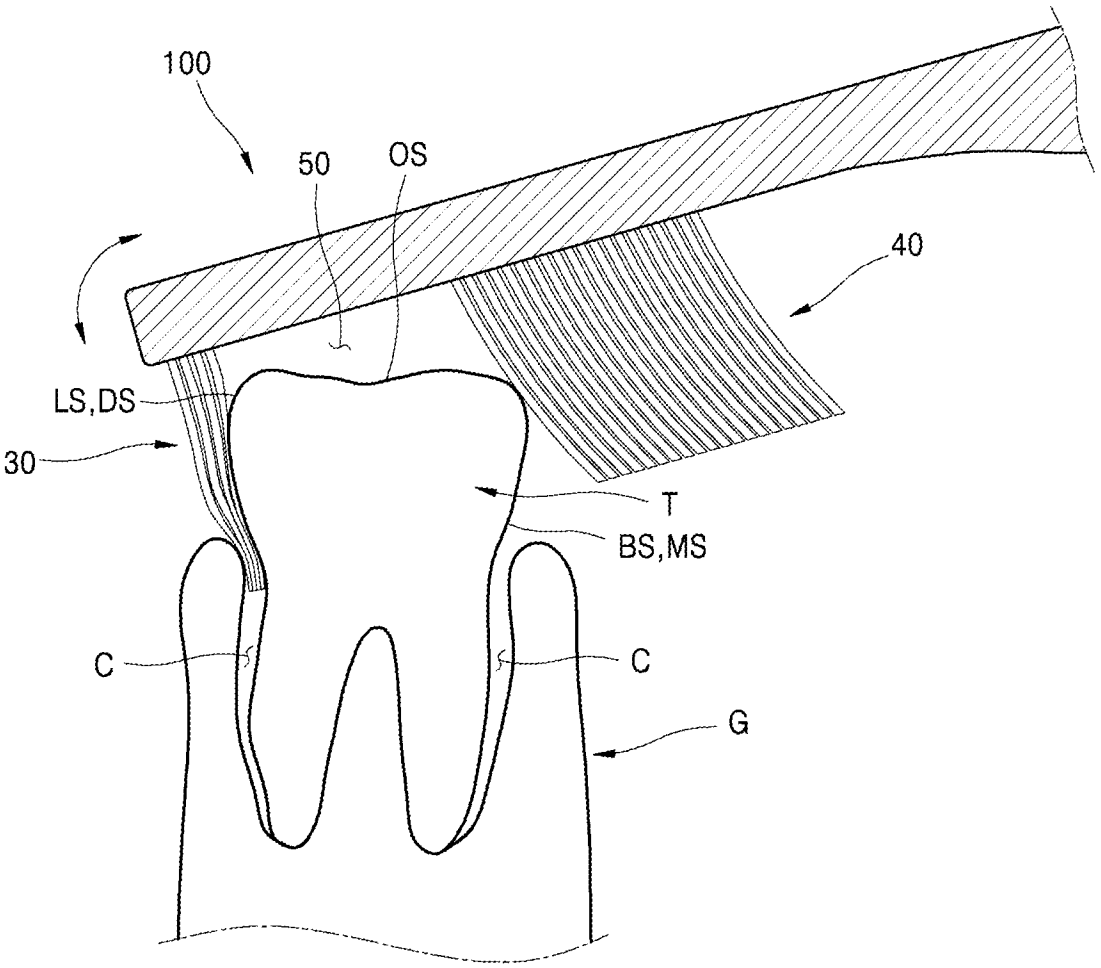
FIGS. 8 to 11 are views for describing a method of using the toothbrush illustrated in FIG. 1.

As illustrated in FIGS. 4 and 8, the first cleaning elements 30 have a maximum height H1 to be insertable to a predetermined depth into the space C between the tooth root surface and the gum G.

In the current embodiment, the maximum height H1 is regarded as an average height H1 because the first cleaning elements 30 have equal heights, and has a value of 10 mm to 15 mm.

The first cleaning elements 30 may be provided in a region having an area corresponding to 10% to 30% of the area of the first surface 21. In the current embodiment, the first cleaning elements 30 are provided in a region having an area corresponding to 10% of the area of the first surface 21.

Herein, when the first cleaning elements 30 are provided in a region having an area corresponding to less than 10% of the area of the first surface 21, the first cleaning elements 30 are not sufficient and thus a cleaning ability of the first cleaning elements 30 is reduced. When the first cleaning elements 30 are provided in a region having an area corresponding to more than 30% of the area of the first surface 21, spaces for providing the second cleaning elements 40 and the tooth space 50 are not sufficient.

The first cleaning elements 30 may be provided along a first circumference A1 corresponding to 20% to 60% of a whole circumference of the first surface 21. In the current embodiment, the first cleaning elements 30 are provided along the first circumference A1 having a length corresponding to 30% of the whole circumference of the first surface 21.

Herein, when the first cleaning elements 30 are provided along the first circumference A1 corresponding to less than 20% of the whole circumference of the first surface 21, a range of a tooth T for which the first cleaning elements 30 are used is reduced. When the first cleaning elements 30 are provided along the first circumference A1 corresponding to more than 60% of the whole circumference of the first surface 21, a space for providing the second cleaning elements 40 is not easily ensured.

The first cleaning elements 30 may be provided in a semi-elliptical band-shaped region having a width B of 2 mm to 4 mm. In the current embodiment, the first cleaning elements 30 are provided in a semi-elliptical band-shaped region having the width B of up to 3 mm.

Herein, when the first cleaning elements 30 have the width B less than 2 mm, the first cleaning elements 30 have a low flexural strength and thus an ability to penetrate into the space C between the tooth root surface and the gum G is reduced. When the first cleaning elements 30 have the width B greater than 4 mm, the first cleaning elements 30 are too thick to be inserted into the space C between the tooth root surface and the gum G.

In the current embodiment, as illustrated in FIG. 3, the band-shaped region where the first cleaning elements 30 are provided has a maximum width B1 of 3 mm near the distal end 13, and has a minimum width B2 of 2 mm near left and right side surfaces 231 of the side surface 23.

As illustrated in FIG. 3, the band-shaped region where the first cleaning elements 30 are provided is approximately determined by a region defined by the first circumference A1, and a third circumference A3 and a boundary S to be described below.

The boundary S is a virtual boundary that distinguishes between the first and second cleaning elements 30 and 40, and may be subjectively determined to some degree. That is, in the current embodiment, the boundary S illustrated in FIG. 4 may move slightly forward or backward and thus cleaning elements included in the first and second cleaning elements 30 and 40 may change.

The region of the first surface 21 where the first cleaning elements 30 are provided has a predetermined length L1 along the longitudinal axis C1 and has a predetermined width V1 along the lateral axis C2. In the current embodiment, the length L1 has a value of 8 mm to 15 mm and the width V1 has a value of 10 mm to 15 mm.

Figure 11:
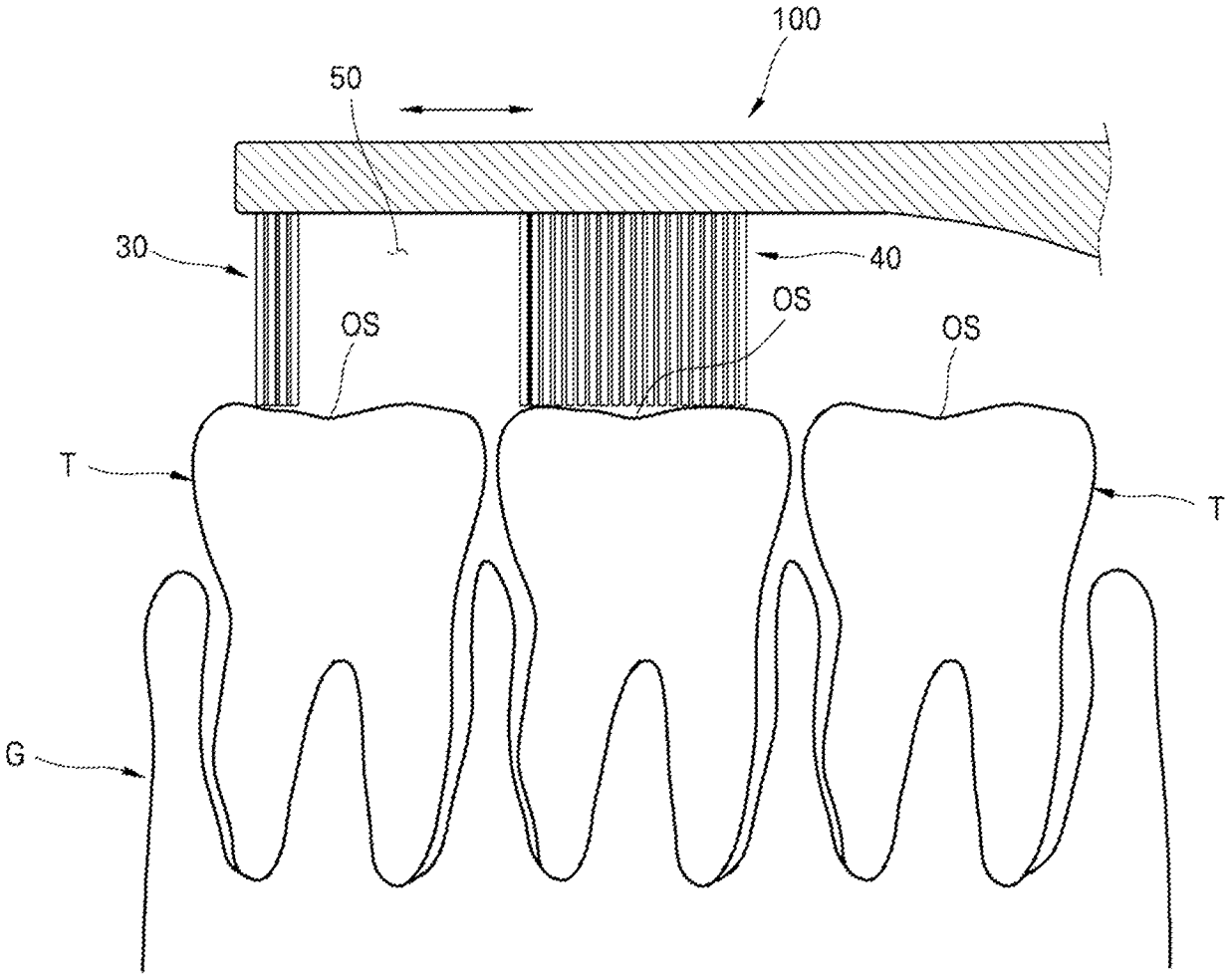

As illustrated in FIG. 11, the second cleaning elements 40 are cleaning elements for cleaning exposed external surfaces of the teeth T, e.g., occlusal surfaces OS of the teeth T, and are provided at the rear end of the first surface 21.

In the current embodiment, like the first cleaning elements 30, a plurality of second cleaning elements 40 are provided as filament bristles.

The second cleaning elements 40 may be provided in a region having an area corresponding to 40% to 60% of the area of the first surface 21. In the current embodiment, the second cleaning elements 40 are provided in a region having an area corresponding to 60% of the area of the first surface 21.

Herein, when the second cleaning elements 40 are provided in a region having an area corresponding to less than 40% of the area of the first surface 21, a cleaning ability of the second cleaning elements 40 is excessively reduced. When the second cleaning elements 40 are provided in a region having an area corresponding to more than 60% of the area of the first surface 21, spaces for providing the first cleaning elements 30 and the tooth space 50 are not easily ensured.

As illustrated in FIG. 3, the region where the second cleaning elements 40 are provided is approximately determined by a region defined by a second circumference A2, the third circumference A3, and the boundary S.

In the current embodiment, the second cleaning elements 40 include cleaning elements provided in a semi-elliptical region having the longitudinal axis C1 of the head 20 as a major axis, i.e., a region determined by the second circumference A2 and the lateral axis C2, and cleaning elements provided in a region determined by the second circumference A2, the lateral axis C2, the boundary S, and the third circumference A3.

The region of the first surface 21 where the second cleaning elements 40 are provided has a predetermined maximum length L2 and minimum length L4 along the longitudinal axis C1 and has a predetermined maximum width V2 along the lateral axis C2. In the current embodiment, the length L2 has a value of 10 mm to 20 mm and the width V2 has a value of 10 mm to 15 mm.

The second cleaning elements 40 have a predetermined maximum height H2. In the current embodiment, the maximum height H2 is regarded as an average height H2 because the second cleaning elements 40 have equal heights, and has a value of 10 mm to 15 mm.

In the current embodiment, the average height H2 of the second cleaning elements 40 is the same as the average height H1 of the first cleaning elements 30.

The second cleaning elements 40 are mainly used to clean exposed external surfaces, e.g., the occlusal surfaces OS, of the teeth T, and thus may have a density greater than the density of the first cleaning elements 30.

The tooth space 50 corresponds to a space provided on the first surface 21 to accommodate a tooth T of a user, and is provided between the first and second cleaning elements 30 and 40.

The tooth space 50 may be provided to accommodate an average-sized molar tooth of people.

The tooth space 50 is provided in an elliptical shape having the longitudinal axis C1 of the head 20 as a major axis.

The tooth space 50 may have a maximum length L3 of 8 mm to 12 mm along the longitudinal axis C1 of the head 20.

The tooth space 50 may have a maximum width V3 of 4 mm to 7 mm along the lateral axis C2 of the head 20.

In the current embodiment, no cleaning elements are provided in a region of the first surface 21 where the tooth space 50 is positioned.

The tooth space 50 may be provided in a region having an area corresponding to 30% to 50% of the area of the first surface 21. In the current embodiment, the tooth space 50 is provided in a region having an area corresponding to 30% of the area of the first surface 21.

Herein, when the tooth space 50 is provided in a region having an area corresponding to less than 30% of the area of the first surface 21, an average-sized molar tooth of people may not be easily accommodated in the tooth space 50. When the tooth space 50 is provided in a region having an area corresponding to more than 50% of the area of the first surface 21, a space for providing the second cleaning elements 40 is not sufficient.

The region where the tooth space 50 is provided is approximately determined by the third circumference A3. Herein, an ellipse center EC of the third circumference A3 serves as a center of the tooth space 50.

Examples of a method of using the above-described toothbrush 100 will now be described.

As illustrated in FIG. 8, the first cleaning elements 30 may be used to clean the space C between the tooth root surface and the gum G, and is particularly useful when the tooth T is a molar tooth.

As illustrated in FIG. 8, when a user positions a front end of the toothbrush 100 near the space C between the gum G and a lingual surface LS or a distal surface DS of the molar tooth T and then scrubs lightly, the first cleaning elements 30 penetrate into the space C. Herein, the second cleaning elements 40 are pressed backward and slightly bent by the molar tooth T. In this case, the tooth T is easily accommodated in the tooth space 50 and thus elastic repulsive force of bristles due to interference between the tooth T and cleaning elements such as the bristles is not generated.

When the user gently vibrates the toothbrush 100 while the first cleaning elements 30 are being penetrated in the space C as described above, foreign substances attached on a root surface of the molar tooth T, e.g., tartar and food residues, are removed.

Figure 9:
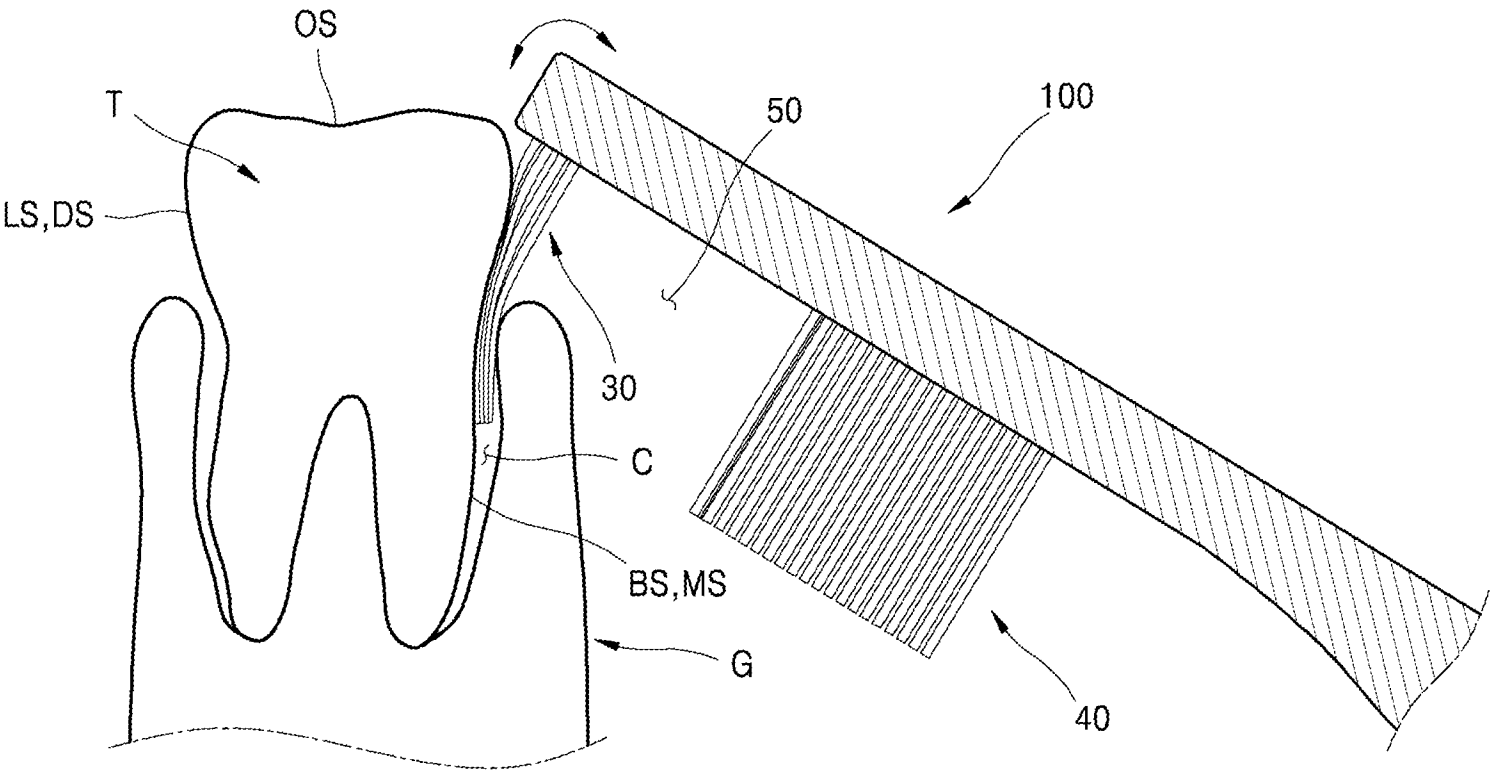

As illustrated in FIG. 9, the first cleaning elements 30 may also be used to clean the space C between the gum G and a buccal surface BS or a mesial surface MS of the molar tooth T. In this case, the molar tooth T may not need to be accommodated in the tooth space 50.

Figure 10:
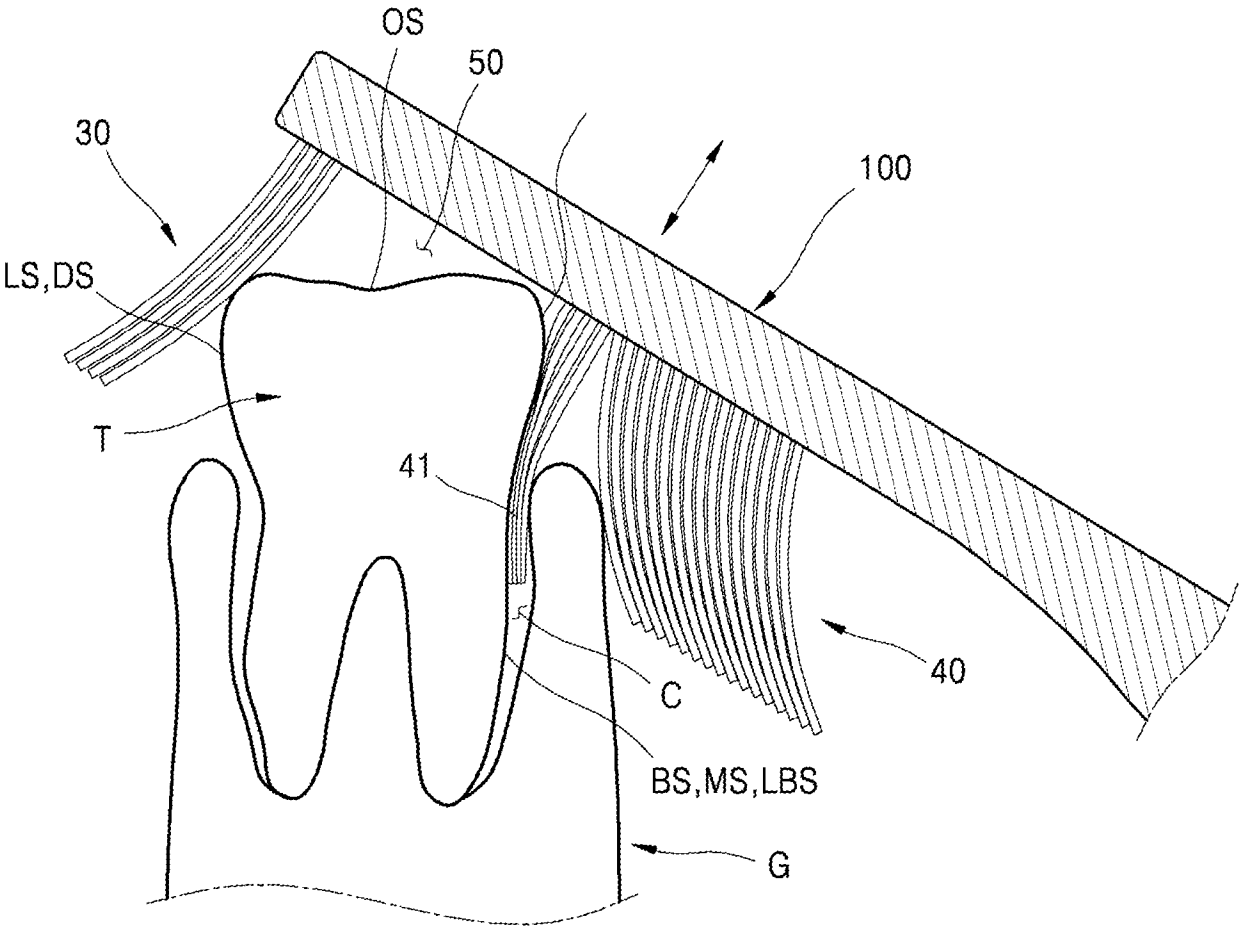

As illustrated in FIG. 10, cleaning elements 41 provided at a front end of the second cleaning elements 40 may be used for the buccal surface BS or a labial surface LBS of the tooth T. In this case, the tooth T is accommodated in the tooth space 50.

As illustrated in FIG. 11, the second cleaning elements 40 are cleaning elements appropriately usable to clean the occlusal surfaces OS of the teeth T. In this case, horizontal scrub toothbrushing is preferable and the first cleaning elements 30 are also used to clean the occlusal surfaces OS of the teeth T.

Based on the above-described toothbrush 100 including the handle 10, the head 20 connected to the handle 10 and including the first surface 21, the distal circumference 24 provided at the front end of the first surface 21, the proximal circumference 25 provided at the rear end of the first surface 21, the longitudinal axis C1, and the lateral axis C2, the plurality of first cleaning elements 30 provided at the front end of the first surface 21 along the distal circumference 24 of the first surface 21, the plurality of second cleaning elements 40 provided at the rear end of the first surface 21, and the tooth space 50 corresponding to a space provided on the first surface 21 between the first and second cleaning elements 30 and 40, when the space C between the tooth root surface and the gum G, e.g., a periodontal pocket, are cleaned, repulsive force of bristles pressed due to interference between the bristles and the tooth T is not generated and thus the first cleaning elements 30 may easily penetrate into the space C.

Based on the toothbrush 100, because the tooth space 50 is provided to accommodate an average-sized molar tooth T of people, even a third molar tooth may be easily accommodated in the tooth space 50 and thus the distal surface DS of the third molar tooth may be easily brushed and cleaned.

Based on the toothbrush 100, because the tooth space 50 is provided in an elliptical shape having the longitudinal axis C1 of the head 20 as a major axis, various-sized teeth T including front teeth and molar teeth may be accommodated in the tooth space 50 at various toothbrush positions.

Based on the toothbrush 100, because the tooth space 50 has the maximum length L3 of 8 mm to 12 mm along the longitudinal axis C1 of the head 20, the largest teeth T of people, i.e., molar teeth, may also be accommodated in the tooth space 50.

Based on the toothbrush 100, because the tooth space 50 has the maximum width V3 of 4 mm to 7 mm along the lateral axis C2 of the head 20, the largest teeth T of people, i.e., molar teeth, may also be accommodated in the tooth space 50.

Based on the toothbrush 100, because no cleaning elements are provided in a region of the first surface 21 where the tooth space 50 is positioned, a depth to which the teeth T are accommodated in the tooth space 50 may be increased.

Based on the toothbrush 100, because the tooth space 50 is provided in a region having an area corresponding to 30% to 50% of the area of the first surface 21, an average-sized molar tooth of people may be accommodated in the tooth space 50 and a space for providing the second cleaning elements 40 may be sufficiently ensured.

Based on the toothbrush 100, because the first cleaning elements 30 have the maximum height H1 to be insertable to a predetermined depth into the space C between the tooth root surface and the gum G, even periodontitis patients who have deep a periodontal pocket may effectively brush their teeth.

Based on the toothbrush 100, because the first cleaning elements 30 are provided in a region having an area corresponding to 10% to 30% of the area of the first surface 21, a cleaning ability of the first cleaning elements 30 may be appropriately ensured and spaces for providing the second cleaning elements 40 and the tooth space 50 may be ensured.

Based on the toothbrush 100, because the first cleaning elements 30 are provided along a circumference corresponding to 20% to 60% of the whole circumference of the first surface 21 and thus not only the first cleaning elements 30 provided near the distal end 13 but also the first cleaning elements 30 provided near the left and right side surfaces 231 of the head 20 are usable, a range of a tooth T for which the first cleaning elements 30 are used may be increased and a space for providing the second cleaning elements 40 may be prepared to an appropriate size.

Based on the toothbrush 100, because the first cleaning elements 30 are provided in a band-shaped region having the width B of 2 mm to 4 mm, a thickness and a flexural strength of the first cleaning elements 30 may be appropriately ensured and thus an ability to penetrate into the space C between the tooth root surface and the gum G may be increased.

Based on the toothbrush 100, because the second cleaning elements 40 are provided in a region having an area corresponding to 40% to 60% of the area of the first surface 21, a cleaning ability of the second cleaning elements 40 may be appropriately ensured and spaces for providing the first cleaning elements 30 and the tooth space 50 may be easily ensured.

Figure 12:
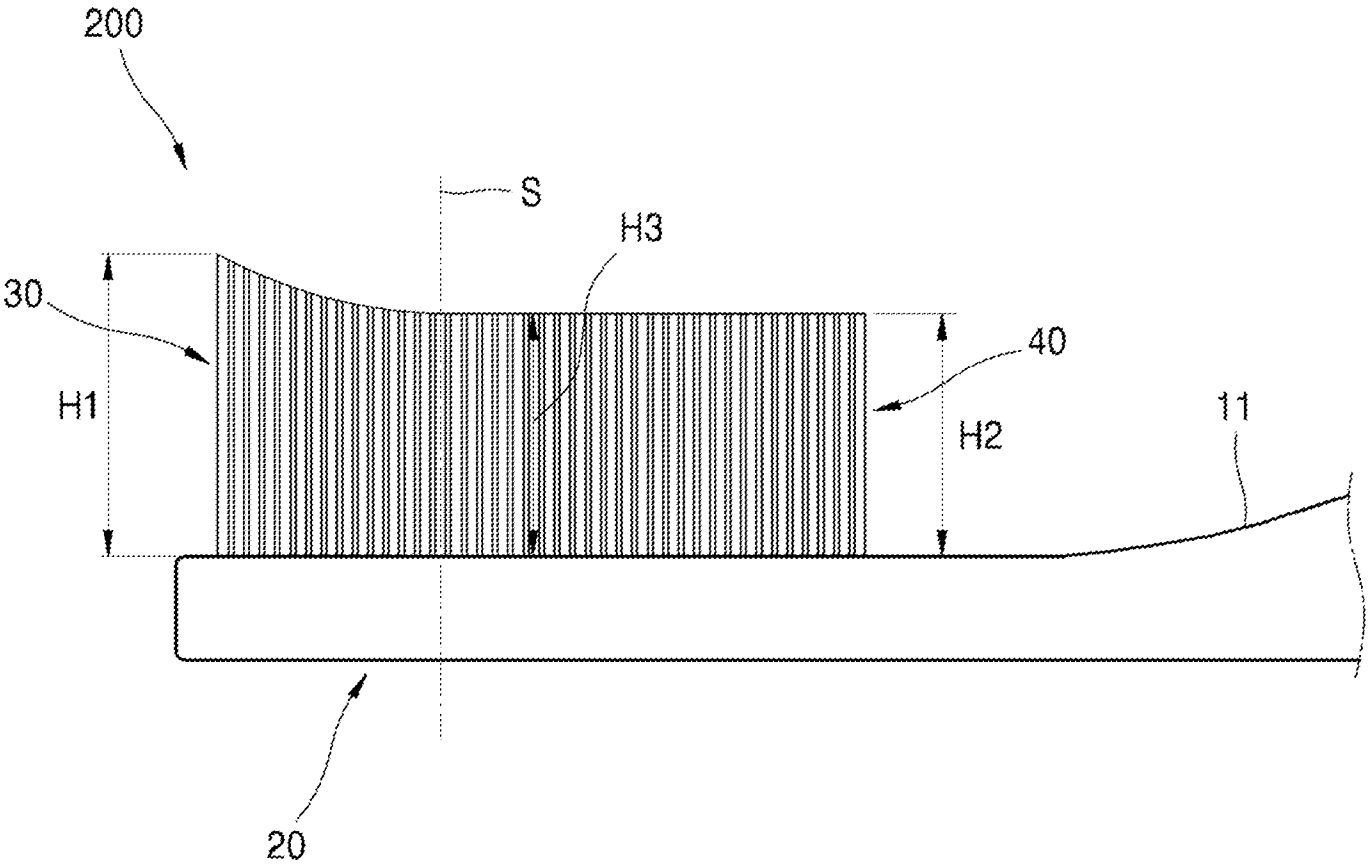
FIG. 12 is a front view of a toothbrush according to a second embodiment of the present invention.

FIG. 12 illustrates a toothbrush 200 according to a second embodiment of the present invention. The configuration and effect of the toothbrush 200 are mostly the same as those of the above-described toothbrush 100 and thus only differences therebetween will now be described.

In the toothbrush 200, a height of the first cleaning elements 30 is gradually reduced from the front end of the first surface 21 toward the rear end of the first surface 21 along the longitudinal axis C1. In this case, the height of the first cleaning elements 30 may be exponentially or parabolically reduced.

That is, the first cleaning elements 30 of the toothbrush 200 may have a predetermined height H1 at the front end of the first surface 21 and have a height H3 less than the height H1 in the middle of the first surface 21. In the current embodiment, the height H3 is the same as a height H2 of the second cleaning elements 40.

Based on the above-described toothbrush 200, a depth to which the first cleaning elements 30 are inserted into the space C such as a periodontal pocket may be increased compared to the above-described toothbrush 100.

Figure 13:
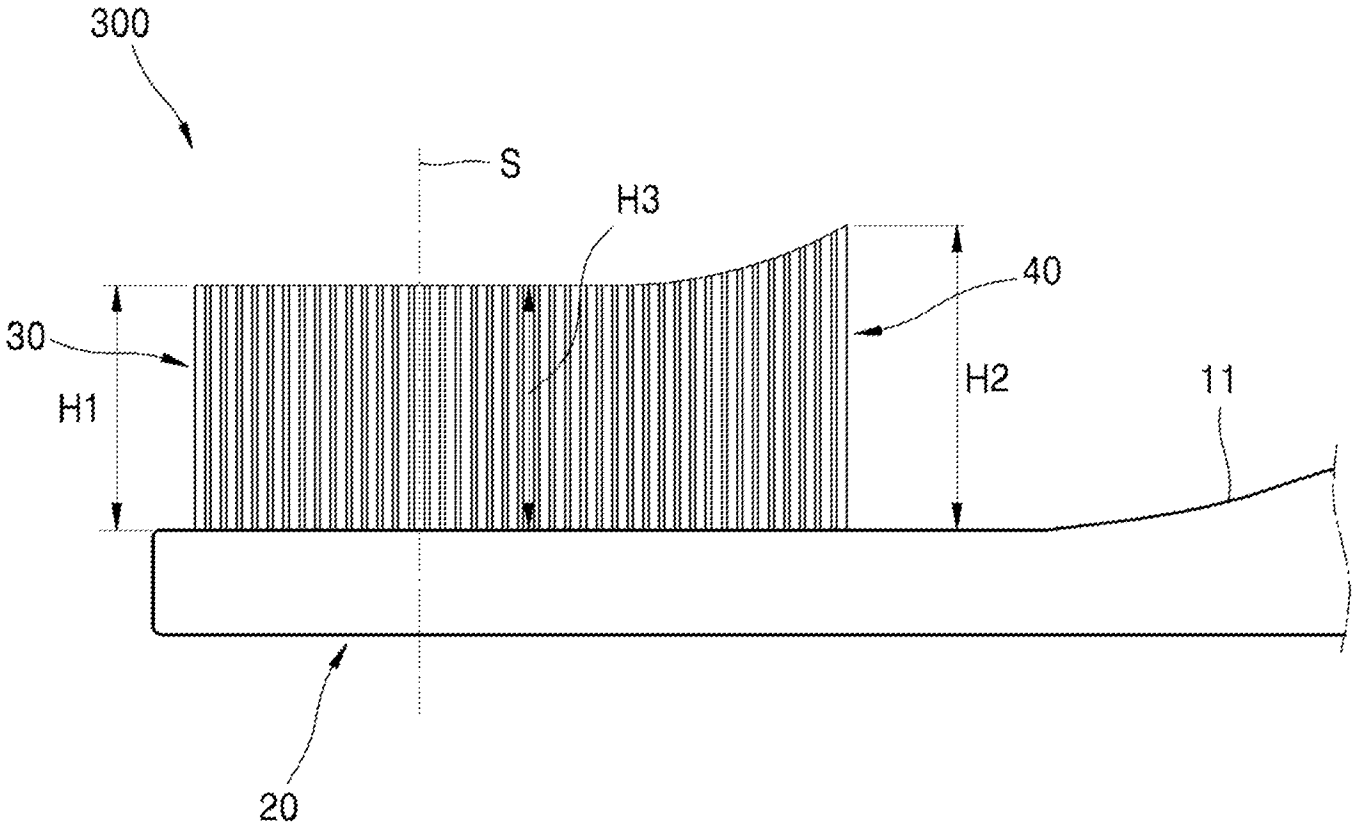
FIG. 13 is a front view of a toothbrush according to a third embodiment of the present invention.

FIG. 13 illustrates a toothbrush 300 according to a third embodiment of the present invention. The configuration and effect of the toothbrush 300 are mostly the same as those of the above-described toothbrush 100 and thus only differences therebetween will now be described.

A height of the second cleaning elements 40 of the toothbrush 300 is gradually reduced from the rear end of the first surface 21 toward the front end of the first surface 21 along the longitudinal axis C1. In this case, the height of the second cleaning elements 40 may be exponentially or parabolically reduced.

That is, the second cleaning elements 40 of the toothbrush 300 may have a predetermined height H2 at the rear end of the first surface 21 and have a height H3 less than the height H2 in the middle of the first surface 21. In the current embodiment, the height H3 is the same as a height H1 of the first cleaning elements 30.

Based on the above-described toothbrush 300, a periodontal pocket near the labial surface LBS of a front tooth may be easily cleaned similarly to the illustration of FIG. 10 by using rear-end cleaning elements of the second cleaning elements 40.

Figure 14:
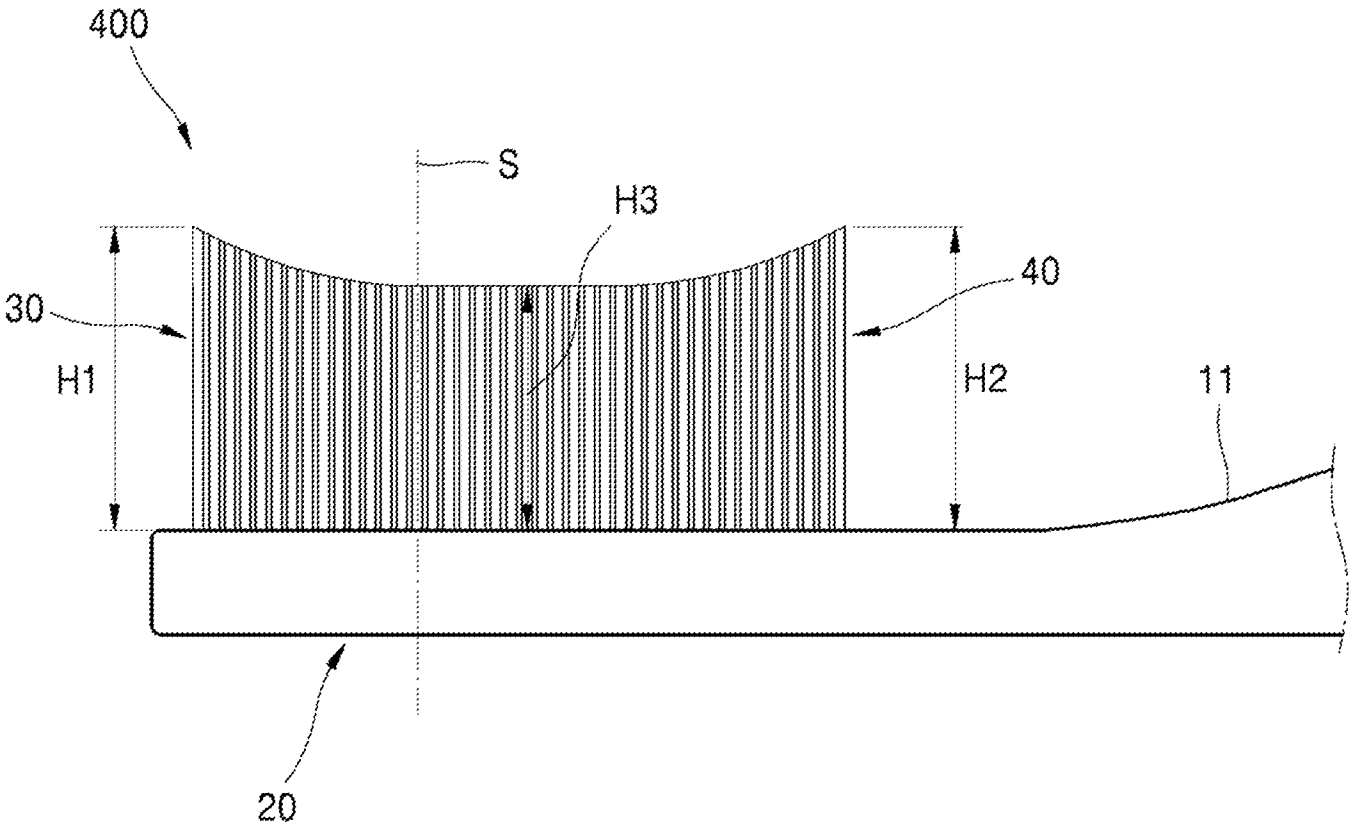
FIG. 14 is a front view of a toothbrush according to a fourth embodiment of the present invention.

FIG. 14 illustrates a toothbrush 400 according to a fourth embodiment of the present invention. The configuration and effect of the toothbrush 400 are mostly the same as those of the above-described toothbrushes 200 and 300 and thus only differences therebetween will now be described.

In the toothbrush 400, a height of the first cleaning elements 30 is gradually reduced from the front end of the first surface 21 toward the rear end of the first surface 21 along the longitudinal axis C1, and a height of the second cleaning elements 40 is gradually reduced from the rear end of the first surface 21 toward the front end of the first surface 21 along the longitudinal axis C1.

That is, in the toothbrush 400, the first cleaning elements 30 have a predetermined height H1 at the front end of the first surface 21, the second cleaning elements 40 have a predetermined height H2 at the rear end of the first surface 21, and the first and second cleaning elements 30 and 40 have a height H3 less than the heights H1 and H2 at the boundary S of the first surface 21. In the current embodiment, the height H1 of the first cleaning elements 30 is the same as the height H2 of the second cleaning elements 40.

The toothbrush 400 has advantages of both of the toothbrushes 200 and 300. That is, periodontal pockets at various positions may be cleaned using a front end of the first cleaning elements 30 and a rear end of the second cleaning elements 40.

Figure 15:
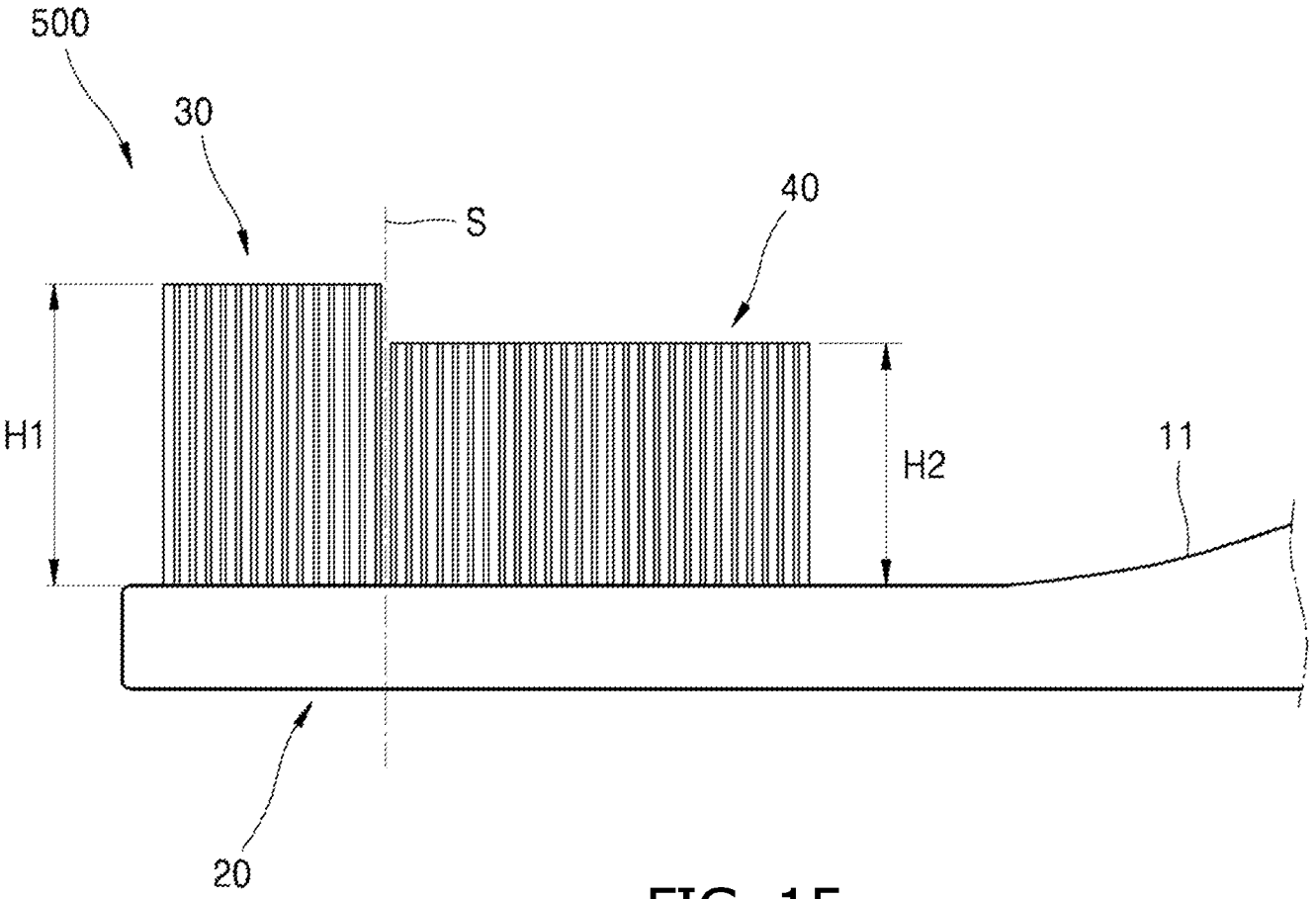
FIG. 15 is a front view of a toothbrush according to a fifth embodiment of the present invention.

FIG. 15 illustrates a toothbrush 500 according to a fifth embodiment of the present invention. The configuration and effect of the toothbrush 500 are mostly the same as those of the above-described toothbrush 100 and thus only differences therebetween will now be described.

The first cleaning elements 30 of the toothbrush 500 have an average height H1 equal to or greater than an average height H2 of the second cleaning elements 40. In the current embodiment, the average height H1 of the first cleaning elements 30 is greater than the average height H2 of the second cleaning elements 40 by 1 mm to 2 mm.

Based on the toothbrush 500, unlike the above-described toothbrush 200, not only the first cleaning elements 30 provided near the distal end 13 but also the first cleaning elements 30 provided near the left and right side surfaces 231 of the head 20 may be increased in depth to be inserted into the space C such as a periodontal pocket.

Figure 16:
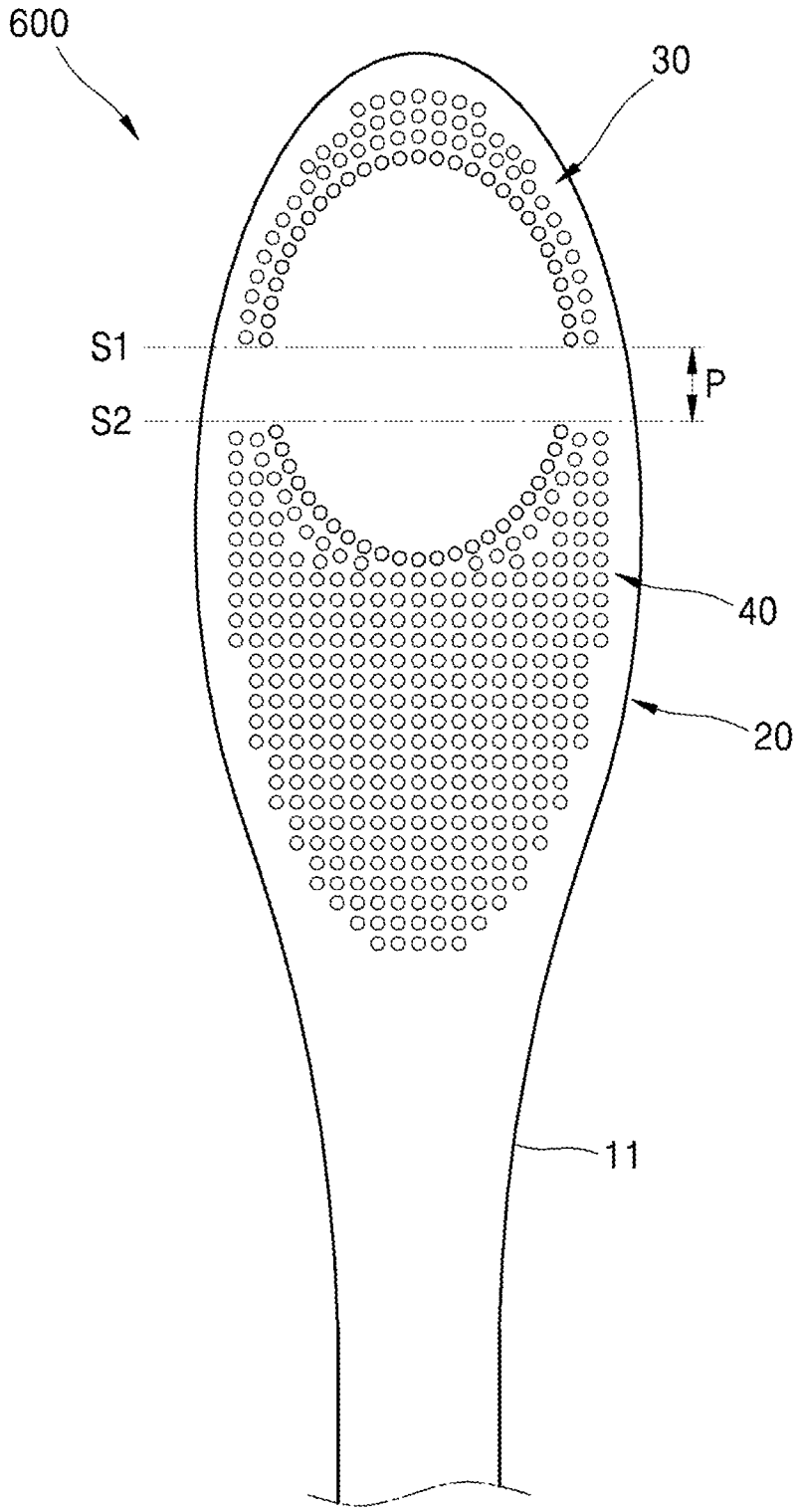
FIG. 16 is a plan view of a toothbrush according to a sixth embodiment of the present invention.
Figure 17:
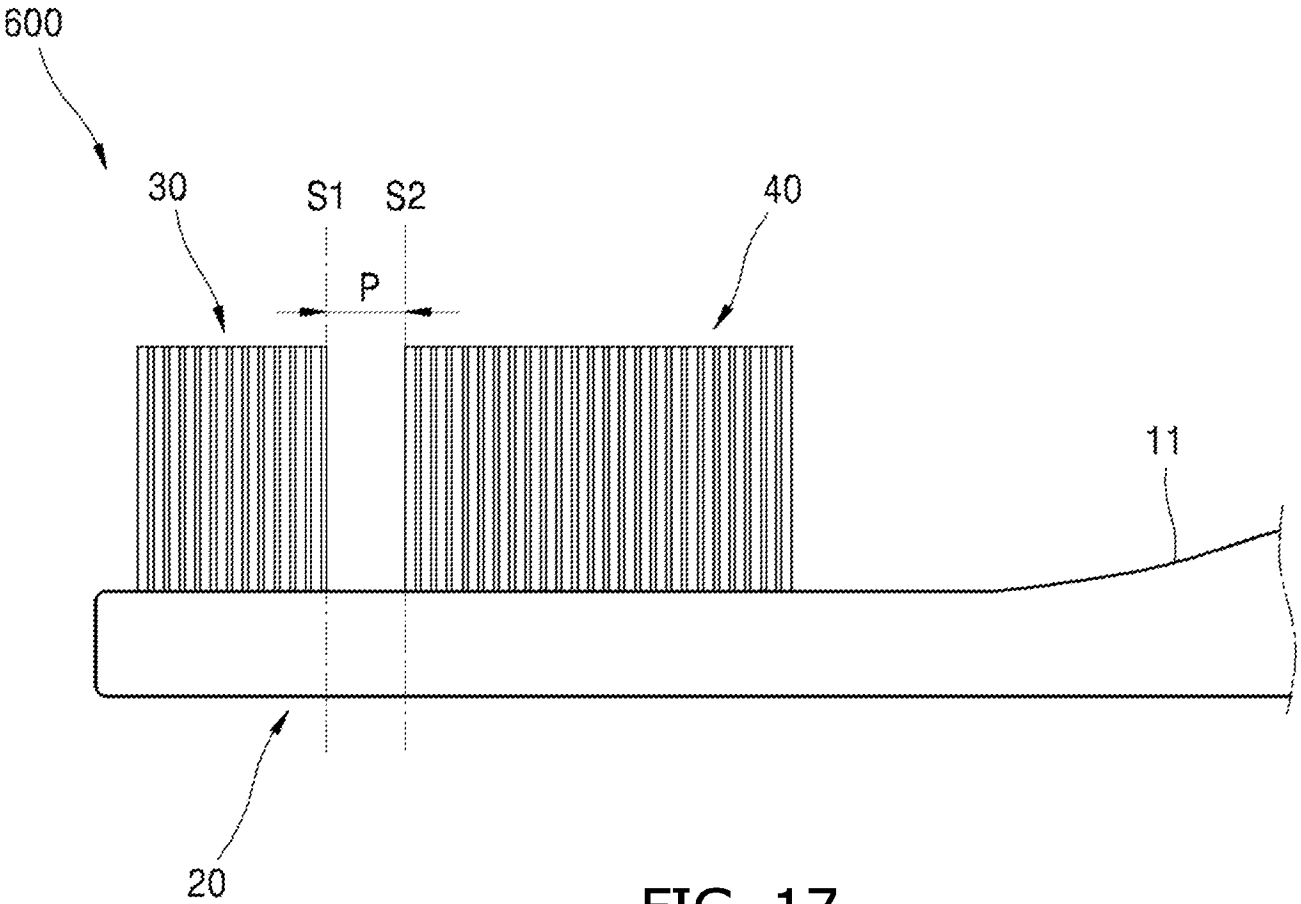
FIG. 17 is a front view of the toothbrush illustrated in FIG. 16.

FIGS. 16 and 17 illustrate a toothbrush 500 according to a sixth embodiment of the present invention. The configuration and effect of the toothbrush 600 are mostly the same as those of the above-described toothbrush 100 and thus only differences therebetween will now be described.

In the toothbrush 600, a minimum distance P between the first and second cleaning elements 30 and 40 is equal to or greater than a predetermined value.

As illustrated in FIG. 16, the minimum distance P is provided by a linear band-shaped space parallel to the lateral axis C2. The linear band-shaped space is determined by a first boundary S1 for defining the first cleaning elements 30 and a second boundary S2 for defining the second cleaning elements 40.

Based on the toothbrush 600, because the first cleaning elements 30 provided near the left and right side surfaces 231 of the head 20 are bendable in various directions, the first cleaning elements 30 may be easily used.

Figure 18:
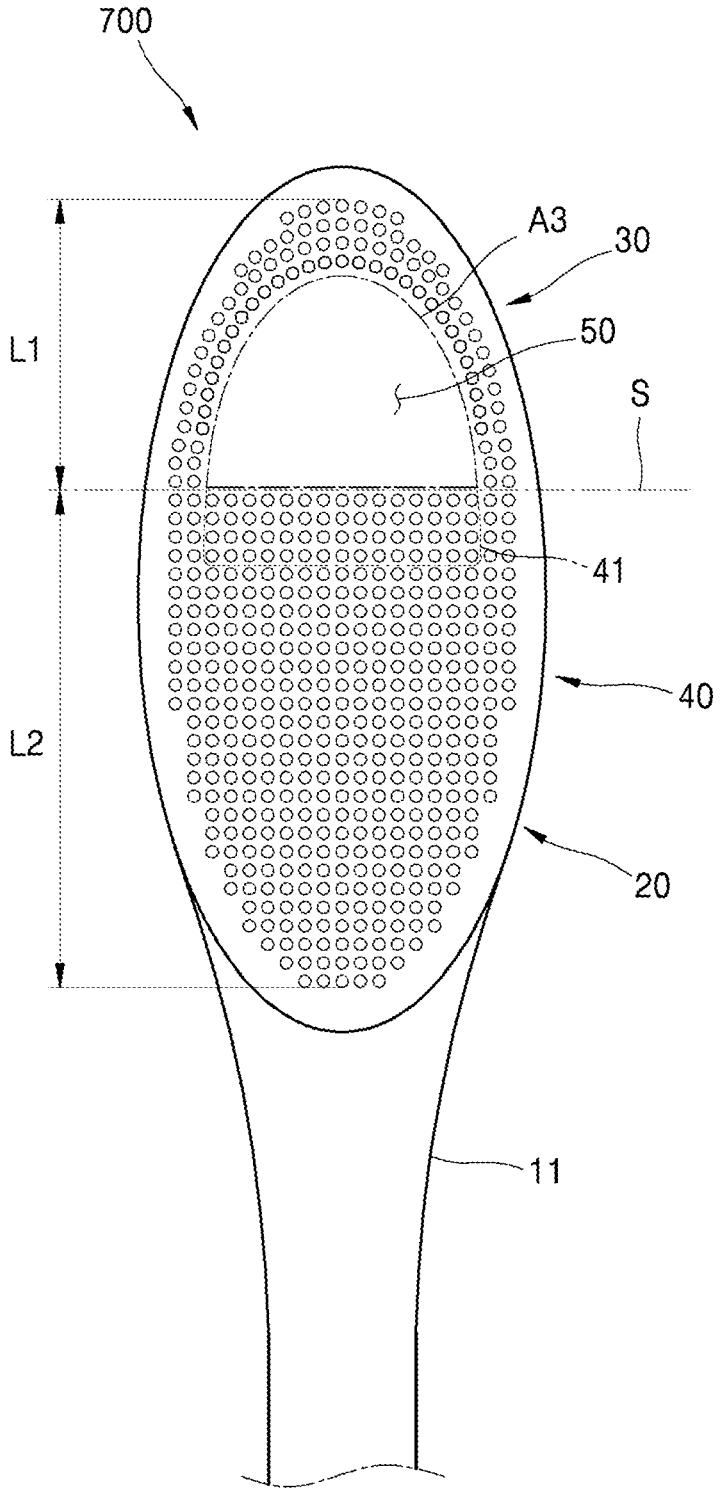
FIG. 18 is a plan view of a toothbrush according to a seventh embodiment of the present invention.

FIG. 18 illustrates a toothbrush 700 according to a seventh embodiment of the present invention. The configuration and effect of the toothbrush 700 are mostly the same as those of the above-described toothbrush 100 and thus only differences therebetween will now be described.

The tooth space 50 of the toothbrush 700 is provided in a semi-elliptical shape having the longitudinal axis C1 of the head 20 as a major axis.

Based on the toothbrush 700, an area of the tooth space 50 may be slightly reduced but be easily ensured.

Based on the toothbrush 700, the cleaning operation illustrated in FIG. 10 may be easily performed using the cleaning elements 41 provided in a linear shape at the front end of the second cleaning elements 40 along the boundary S.

Figure 19:
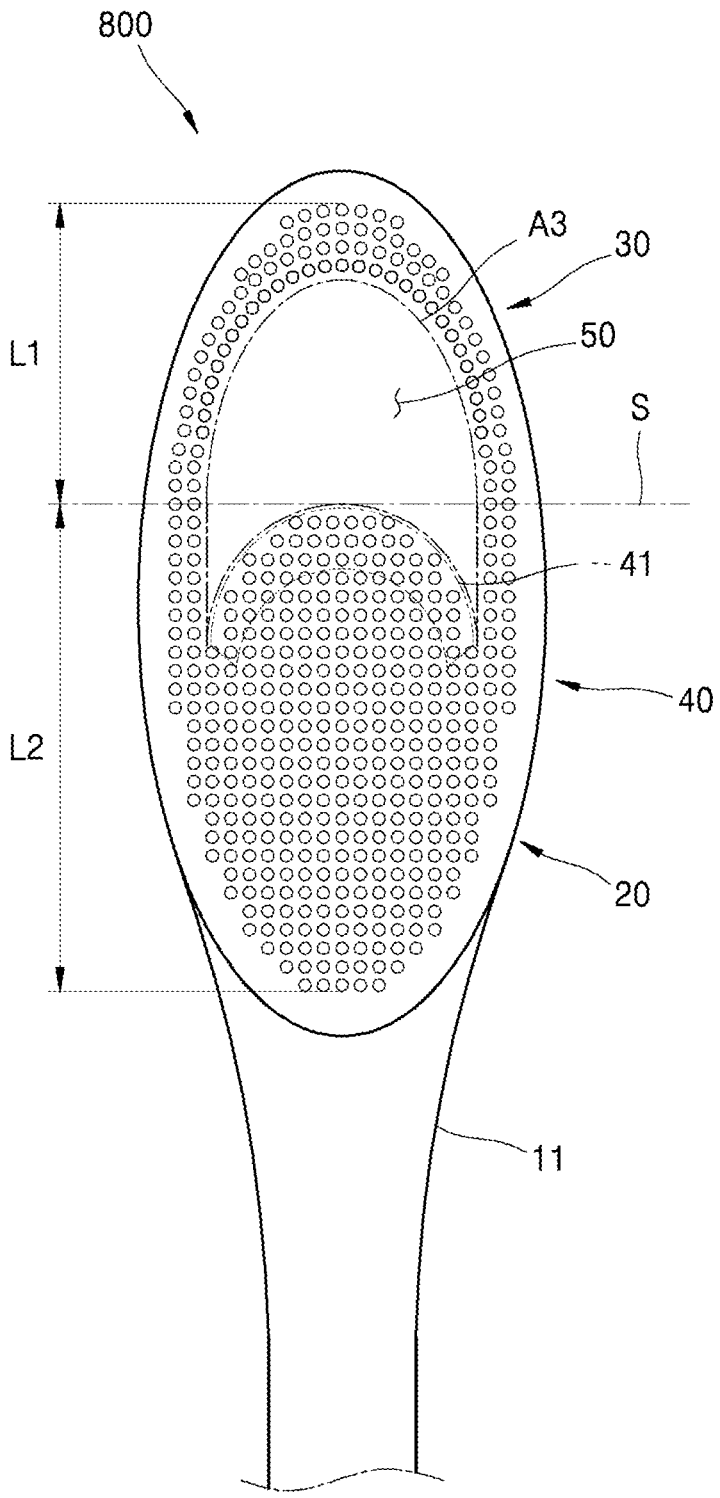
FIG. 19 is a plan view of a toothbrush according to an eighth embodiment of the present invention.

FIG. 19 illustrates a toothbrush 800 according to an eighth embodiment the present invention. The configuration and effect of the toothbrush 800 are mostly the same as those of the above-described toothbrush 100 and thus only differences therebetween will now be described.

The second cleaning elements 40 of the toothbrush 800 include cleaning elements provided in an elliptical region having the longitudinal axis C1 of the head 20 as a major axis.

Based on the toothbrush 800, the cleaning operation illustrated in FIG. 10 may be easily performed using the cleaning elements 41 provided in a curved shape at the front end of the second cleaning elements 40 along a boundary of the elliptical region.

Although a manual toothbrush is explained as an example in the afore-described embodiments, the toothbrush 100 or the like may be an electric toothbrush or any other handled oral care tool designed for dental treatments.

Although the handle 10 and the head 20 are formed as a single structure in the afore-described embodiments, the handle 10 and the head 20 may be formed as separate components and be operatively connected in a subsequent manufacturing process by using an appropriate technique known in the art, e.g., thermal welding, tight-fit assembly, coupling sleeves, bonding, or fasteners.

Although no cleaning elements are provided in a region of the first surface 21 where the tooth space 50 is positioned, in the afore-described embodiments, short cleaning elements may be provided in the tooth space 50 as long as accommodation of the tooth T is not disturbed.

While the present invention has been particularly shown and described with reference to embodiments thereof, it will be understood by one of ordinary skill in the art that various changes in form and details may be made therein without departing from the scope of the present invention as defined by the following claims.

The invention claimed is:

1. A toothbrush comprising:

a handle;

a head connected to the handle and comprising a first surface, a distal circumference provided at a front end of the first surface, a proximal circumference provided at a rear end of the first surface, a longitudinal axis, and a lateral axis;

a plurality of first cleaning elements provided at the front end of the first surface along the distal circumference of the first surface;

a plurality of second cleaning elements provided at the rear end of the first surface; and a single tooth space corresponding to a space provided on the first surface and having a periphery defined by the first and second cleaning elements, wherein the tooth space is provided to accommodate an average-sized molar tooth of people, wherein the second cleaning elements are provided in a region having an area corresponding to 40% to 60% of an area of the first surface, wherein the handle is connected to the rear end of the first surface, wherein the tooth space is provided in an elliptical shape having the longitudinal axis of the head as a major axis, wherein a center of the tooth space is disposed in the front end of the first surface, wherein the first cleaning elements are provided in a semi-elliptical shaped region having a width.

2. The toothbrush of claim 1, wherein the tooth space has a maximum length of 8 mm to 12 mm along the longitudinal axis of the head.

3. The toothbrush of claim 1, wherein the tooth space has a maximum width of 4 mm to 7 mm along the lateral axis of the head.

4. The toothbrush of claim 1, wherein the tooth space is provided in a region having an area corresponding to 30% to 50% of an area of the first surface.

* * * * *